US006894221B2

(12) United States Patent
Gorman

(10) Patent No.: US 6,894,221 B2
(45) Date of Patent: May 17, 2005

(54) SAFETY OUTLET MODULE

(75) Inventor: Michael P. Gorman, Laguna Niguel, CA (US)

(73) Assignee: Protect Connect, Irvine, CA (US)

( * ) Notice: Subject to any disclaimer, the term of this patent is extended or adjusted under 35 U.S.C. 154(b) by 0 days.

(21) Appl. No.: 10/737,713

(22) Filed: Dec. 16, 2003

(65) Prior Publication Data

US 2004/0177986 A1 Sep. 16, 2004

Related U.S. Application Data

(60) Provisional application No. 60/434,002, filed on Dec. 16, 2002.

(51) Int. Cl.[7] ..... H01H 13/04

(52) U.S. Cl. ..... 174/53; 174/59; 174/135; 439/131; 439/135

(58) Field of Search ..... 174/53, 60, 59, 174/135; 439/140, 502, 527, 131, 172, 173, 135, 535

(56) References Cited

U.S. PATENT DOCUMENTS

| | | | | | |
|---|---|---|---|---|---|
| 723,866 | A | | 3/1903 | Hart | |
| 776,855 | A | | 12/1904 | La Har | |
| 949,123 | A | | 2/1910 | Klein | |
| 1,171,914 | A | | 2/1916 | Wright | |
| 1,328,224 | A | | 1/1920 | Benjamin | |
| 2,447,597 | A | | 8/1948 | Reed | |
| 2,477,803 | A | | 8/1949 | Huber | |
| 2,524,701 | A | | 10/1950 | Grill | |
| 3,214,726 | A | | 10/1965 | Cardenas et al. | |
| 3,317,881 | A | | 5/1967 | Setecka | |
| 3,588,786 | A | | 6/1971 | Alfiero | |
| 3,930,704 | A | | 1/1976 | Dekanic | |
| 4,148,536 | A | | 4/1979 | Petropoulsos et al. | |
| 4,179,175 | A | | 12/1979 | Farnworth et al. | |
| 4,230,386 | A | | 10/1980 | Farnworth et al. | |
| 4,343,411 | A | | 8/1982 | Chesnut et al. | |
| 4,445,739 | A | | 5/1984 | Wooten | |
| 4,493,517 | A | | 1/1985 | Hillary | |
| 4,600,258 | A | | 7/1986 | Hu | |
| 4,605,270 | A | | 8/1986 | Aslizadeh | |
| 4,640,564 | A | | 2/1987 | Hill | |
| 4,722,693 | A | | 2/1988 | Rose | |
| 4,798,916 | A | | 1/1989 | Engel | |
| 4,808,127 | A | | 2/1989 | Swanic | |
| 5,297,973 | A | | 3/1994 | Gorman | |
| 5,551,884 | A | | 9/1996 | Burkhart, Sr. | |
| 5,611,701 | A | | 3/1997 | Hahn | |
| 5,773,757 | A | * | 6/1998 | Kenney | 174/53 |
| 5,980,279 | A | | 11/1999 | Muller | |
| 6,201,187 | B1 | * | 3/2001 | Burbine | 174/60 |
| 6,231,358 | B1 | | 5/2001 | Kerr | |
| 6,441,304 | B1 | * | 8/2002 | Currier et al. | 174/53 |
| 6,492,591 | B1 | * | 12/2002 | Metcalf | 174/53 |
| 6,642,450 | B1 | * | 11/2003 | Hsiao | 174/53 |
| 6,700,062 | B1 | * | 3/2004 | Allen, Jr. | 174/53 |
| 6,747,206 | B1 | * | 6/2004 | Law | 174/53 |

OTHER PUBLICATIONS

Cooper Industries, Inc.; Crouse–Hinds Division; Power–Lock Locking Devices—Product Specification 1996; pp. B6. B55; Syracuse, NY.

* cited by examiner

*Primary Examiner*—Dhiru R. Patel
(74) *Attorney, Agent, or Firm*—Glenn R. Smith

(57) ABSTRACT

A safety outlet module includes a housing, a receptacle defined by the housing, an aperture defined within the receptacle, a cover slidably retained within the receptacle and a plug retained at least partially within the housing. The receptacle has an opening, a bottom and a wall extending between the opening and the bottom. The aperture partially extends along the wall. The cover has a closed position proximate the opening and an open position proximate the bottom. The aperture is blocked in the closed position and exposed in the open position. The plug extends from a housing face and is adapted to removably connect to an electrical power source. A contact is retained by the housing outside of the receptacle and proximate to the aperture, and a buss internal to the housing connects the plug to the contact.

16 Claims, 19 Drawing Sheets

SAFETY OUTLET MODULE

CROSS-REFERENCE TO RELATED APPLICATIONS

This application relates to and claims the benefit of prior U.S. Provisional Application No. 60/434,002 entitled Safety Plug and Covered Outlet Module, filed Dec. 16, 2002, incorporated by reference herein.

BACKGROUND OF THE INVENTION

Standard AC electrical distribution systems are comprised of electrical boxes mounted within building walls at various locations, along with switch and outlet assemblies installed within the boxes. During a roughing phase of construction, the electrical boxes are mounted to wall studs at predetermined locations. After the boxes are installed, a journeyman electrician routes power cables through building framing to the appropriate boxes. The power cables are fed through openings in the rear or sides of the electrical boxes and folded back into the boxes, unterminated, so as to be out of the way until the next phase. During a makeup phase, wall panels are installed and painted, and the journeyman returns to the construction site to install the switch and outlet assemblies into the electrical boxes. After conductors are wired to the assemblies, the assemblies and attached conductors are pushed into the electrical box and the assemblies are attached to the top and bottom of the boxes with screws. During a trim phase, face plates are mounted over the open-end of the electrical boxes, completing the standard electrical wiring process.

SUMMARY OF THE INVENTION

From a user's perspective, there are problems with repair of the standard electrical wiring. Replacement of a broken outlet or switch requires removal of the wall plate and the screws that attach the outlet or switch assembly to the top and bottom of the electrical box. The assembly is then removed from the box, and the power cable conductors are removed by loosing screws on the sides of the outlet or switch assembly. The process is then reversed to attach the cable conductors to a new assembly and mount the new assembly into the electrical box.

The replacement procedure described above exposes the user to AC wiring upon removal of the face plate. This exposure creates a shock hazard. Further, a user's reluctance to change out broken outlets or switches or to spend the money to hire an electrician also creates a shock and a fire hazard from continued use of cracked, broken or excessively worn assemblies. In addition, the integrity of the original wiring becomes questionable if a homeowner or other third party removes and replaces an outlet or switch. Miswiring by a third party can violate building codes and create shock and fire hazards, such as inadvertently switching the hot and neutral conductors, failing to attach ground wires, kinking or nicking conductors and improperly tightening connections.

Removable functional modules configured to be plugged into or unplugged from a wiring module benefit electrical contractors and users alike. Such modules may include switch modules, modules having conventional outlets, or safety outlet modules with covered receptacles, to name a few. Homeowners can easily and safely replace broken outlet and switch modules by simply unplugging such modules from the wiring module, without exposure to power cabling. Safety is enhanced by reducing exposure to electrical wiring and encouraging replacement of defective outlets and switches. Further, maintenance costs are reduced by reducing the need to hire an electrician for repairs. Wiring integrity is insured by reducing the opportunity for unqualified third parties to access the electrical system.

Another safety concern is associated with conventional electrical outlets, which have open slots that expose children to potentially lethal electrical shock hazards. A curious child is prone to insert a conductive object into one of the slots. A child can be shocked if they are in simultaneous contact with a "hot" conductor and a low impedance path to ground. To avoid this risk, parents of young children frequently insert nonconductive plugs into all unused outlets to block out other objects. These plugs, however, significantly reduce outlet convenience. Standard AC plugs also create a shock hazard due to their tendency to pull partially out of an outlet, leaving exposed prongs that remain connected to electrical power. A child can easily touch these with their small fingers or a conductive object. Further, in research, industrial or military environments, an explosion hazard exists when electrical outlets are used in the vicinity of volatile chemicals and gases, which can be ignited with an inadvertent spark at an exposed contact.

One aspect of a safety outlet module comprises a housing, a receptacle defined by the housing, an aperture defined within the receptacle, a cover slidably retained within the receptacle and a plug retained at least partially within the housing. The receptacle has an opening, a bottom and a wall extending between the opening and the bottom. The aperture partially extends along the wall. The cover has a closed position proximate the opening and an open position proximate the bottom. The aperture is blocked in the closed position and exposed in the open position. The plug extends from a housing face and is adapted to removably connect to an electrical power source. A contact is retained by the housing outside of the receptacle and proximate to the aperture, and a buss internal to the housing connects the plug to the contact.

The safety outlet module may further comprise a shield, a ground bar, a ground sleeve and a ground bus. The shield extends from the housing face and is disposed around the plug so as to substantially enclose the plug. The ground bar extends from the housing face. The ground sleeve is disposed within the receptacle and extending along the wall. The ground buss is internal to the housing and connects the ground sleeve to the ground bar.

In one embodiment, the outlet module further comprises a second aperture defined within the receptacle and partially extending along the wall, a second contact retained by the housing outside of the receptacle and proximate to the second aperture, a second plug retained at least partially within the housing and extending from the housing face and adapted to removably connect to the electrical power source, a second buss internal to the housing connecting the second plug to the second contact. The busses provide hot and neutral electrical paths between the plugs and the contacts. The outlet module may further comprise an end cap attachable to the housing so as to form the receptacle bottom and a spring retained between the end cap and the cover so as to urge the cover to the closed position. The receptacle may have a cross-section generally comprising a trapezoid having a wide base, a narrow base parallel to the wide base, and two lateral sides each connecting the wide base and the narrow base. A notch may extend from the narrow side. The ground sleeve may be disposed within the notch, and the apertures may be disposed on the lateral sides and may be relatively offset along the lateral sides.

In another embodiment, the outlet module further comprises a plurality of attachment ears disposed on diagonal corners of the housing and adapted to mount the housing to a wiring panel disposed within an electrical box. A plurality of posts may extend from an inside portion of the housing, allowing the end cap to be heat staked to the posts. Further, the cover may comprise a plurality of blocks configured to retain the cover within the receptacle.

Another aspect of a safety outlet module comprises a housing, a plurality of shielded plugs and a plurality of covered receptacles. The shielded plugs extend from a plug-in side of the housing and are adapted to mesh with a corresponding plurality of structured sockets disposed on a wiring panel so as to electrically communicate with a power cable wired to the wiring panel. The covered receptacles are disposed on a functional side of the housing, and each of the receptacles are adapted to receive a corresponding plurality of locking plugs. The shielded plugs are configured to transmit electrical power to the covered receptacles. The covered receptacles are configured to transmit electrical power to the locking plugs.

In one embodiment, the outlet module further comprises a plurality of apertures disposed within the receptacles and a plurality of contacts recessed from the receptacles proximate the apertures. The apertures are adapted to pass through to the contacts a corresponding plurality of prongs extending from the locking plug so as to enable the prongs to electrically connect with the contacts and to retain the locking plugs within the receptacles. A plurality of attachment ears may be disposed on the housing and adapted to install the housing within an electrical box in conjunction with the wiring panel. The outlet module may further comprise a plurality of covers, a plurality of end caps, a plurality of cover springs and a plurality of busses. The covers are inserted into the receptacles from an inside portion of the housing and retained within the receptacles by blocks disposed on the covers. The end caps are attached to the inside portion of the housing so as to form bottom portions of the receptacles. The cover springs are disposed between the covers and the end caps so as to urge the covers to a closed position. The busses have first end portions corresponding to conductive portions of the shielded plugs and second end portions corresponding to the contacts.

A further aspect of an safety outlet module comprises a housing means for retaining a plurality of conductive elements, a shielded plug means for removably installing the housing means within an electrical box and for mechanically and electrically connecting the conductive elements to an electrical power source, and a receptacle means for transmitting power from the electrical power source to an electrical load in an open position and for blocking exposure to the electrical power source in a closed position. The shield plug means is disposed on a plug-in side of the housing means. The receptacle means is disposed on a functional side of the housing means. The safety outlet module may further comprise a recessed contact means disposed within the housing means and outside the receptacle means for providing an electrical connection to a plug inserted into the covered receptacle means and an aperture means defined within the receptacle means for providing access to a prong portion of the plug to the contact means and for retaining the plug within the receptacle means. The safety outlet module may additionally comprise a cover means for blocking the aperture means and the recessed contact means in a closed position and for providing access to the contact means by the prong portion of the plug in an open position.

BRIEF DESCRIPTION OF THE DRAWINGS

FIGS. 8A–B are back and front perspective views, respectively, of a locking plug in an unlocked state;

FIGS. 8C–D are back and front perspective views, respectively, of a locking plug in a locked state;

FIG. 8E is a back perspective view of an adapter locking plug with the socket door removed; and FIG. 8F is an exploded back perspective view of a locking plug;

DETAILED DESCRIPTION OF THE PREFERRED EMBODIMENTS

Overview

Figure 1A:
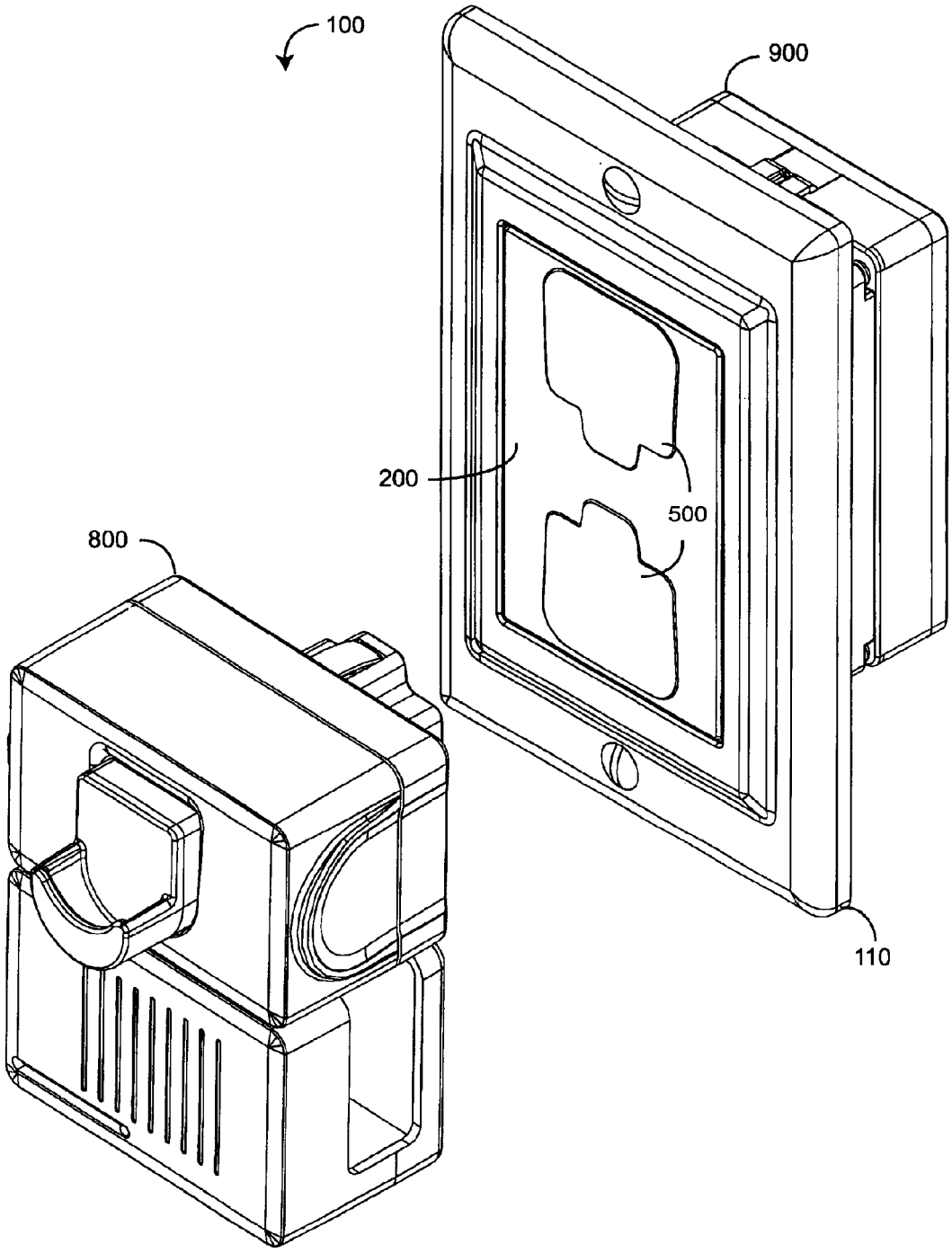
FIGS. 1A–D are perspective views of an electrical distribution system, which includes a safety outlet module.

FIGS. 1A–D illustrate a safety power distribution system 100 having a safety outlet module 200, a corresponding locking plug 800 and wiring module 900. The safety outlet module 200 is configured to removably plug into the wiring module 900 and, thus, advantageously provides the safety and convenience features of a replaceable functional module, as described above. Further, the outlet module 200 has spring-loaded covers 500 that block small children from probing the outlet receptacles 220 with fingers and foreign objects, yet allows adults to insert the locking plug 800 without cover removal. Internally, outlet receptacles 220 have no exposed contacts, further reducing the potential for electrical shock. A face plate 110 provides aesthetic wall trim for the outlet module 200. The locking plug 800 is configured to compress the receptacles covers 500 when inserted into the outlet module 200. The locking plug 800 has retracting prongs 832 (FIGS. 8A–D) that extend within the outlet receptacles 220 to make a fully-enclosed electrical connection and to hold the locking plug 800 in place. The locking plug 800 can be pre-wired to an electrical load or extension cord, for example, or configured as an adapter that converts a conventional AC plug to a locking plug 800.

Figure 1B:
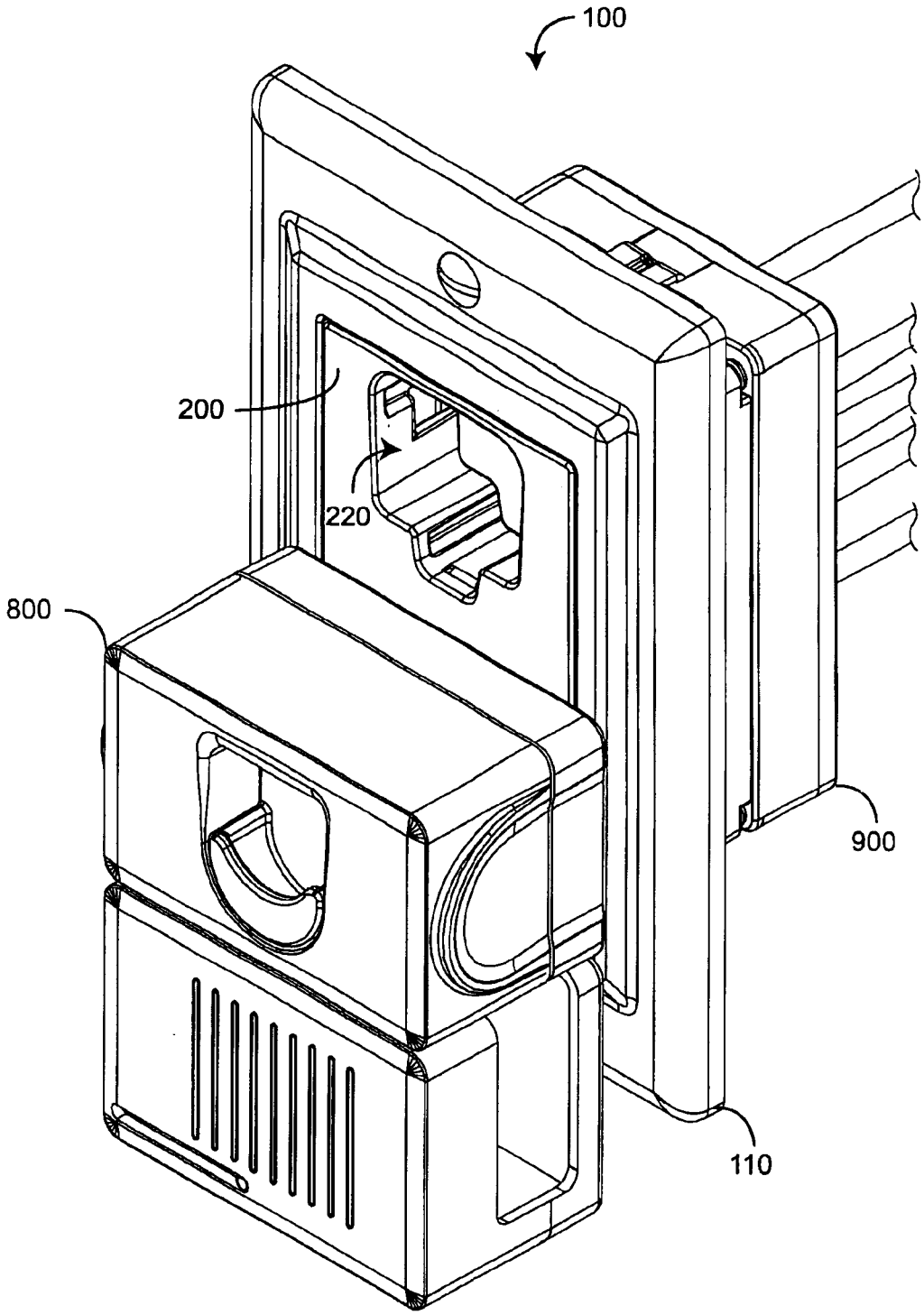
Figure 1C:
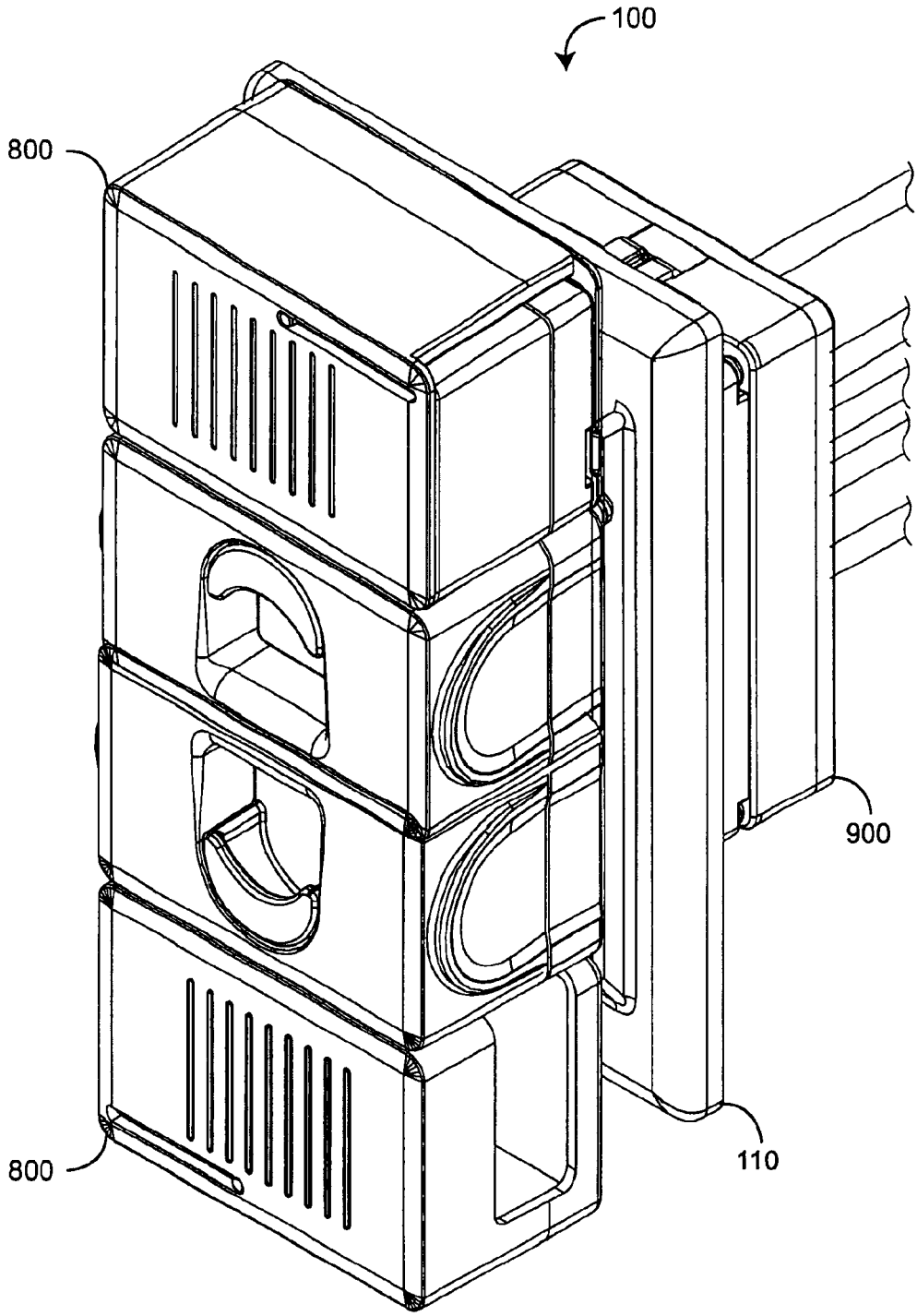
Figure 8A:
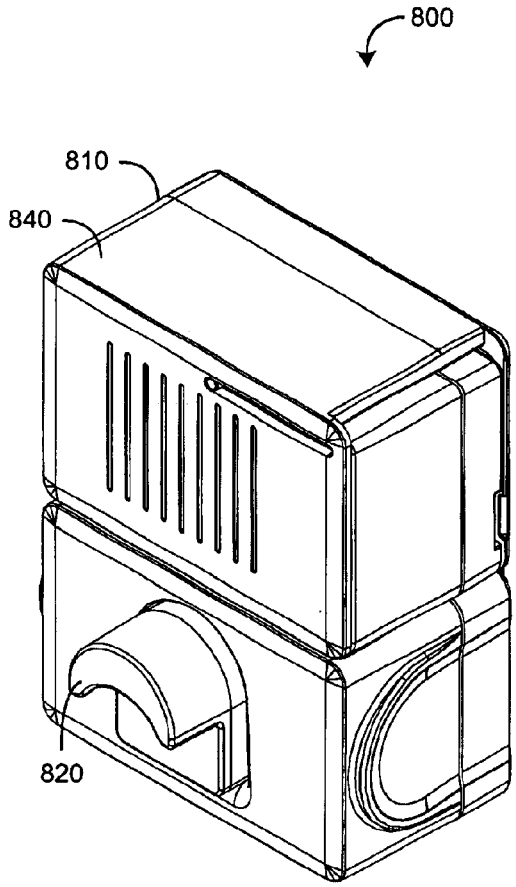
FIGS. 8A–F are perspective views of a locking plug.
Figure 8B:
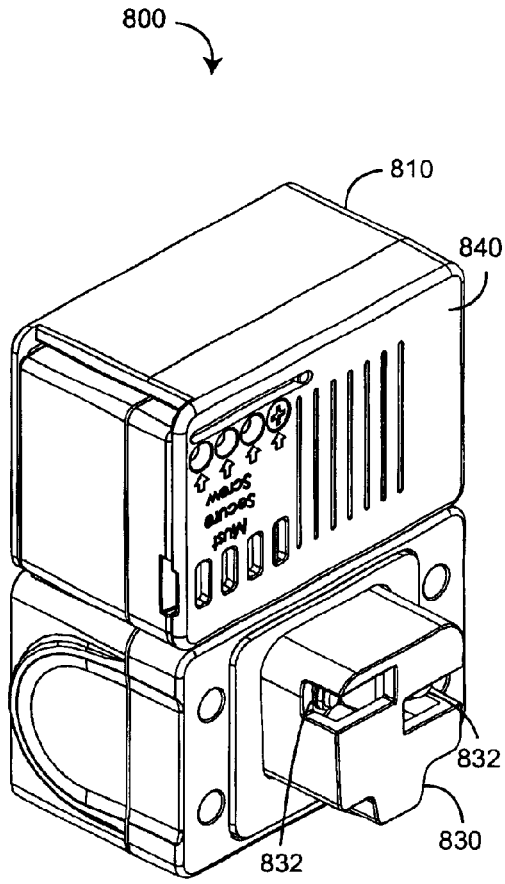
Figure 8C:
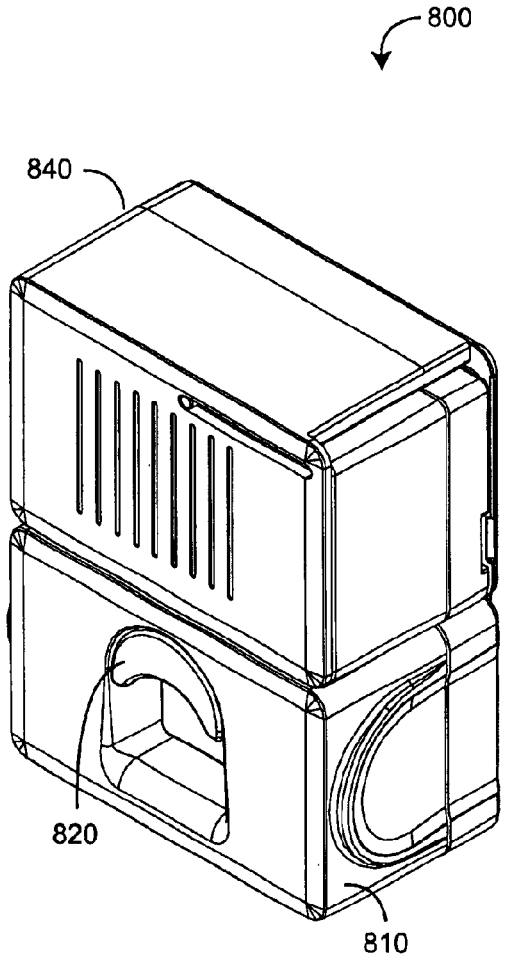
Figure 8D:
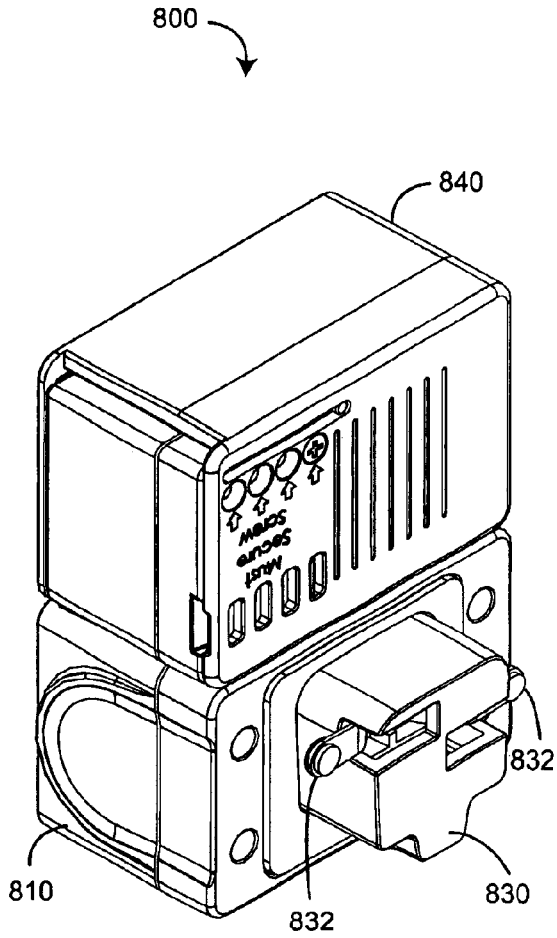

As shown in FIG. 1A, the outlet module 200 and locking plug 800 have a disengaged position where the receptacles 220 of the outlet module 200 are covered and the locking plug 800 is separated from the outlet module 200 and set to an unlocked state (FIGS. 8A–B). As shown in FIG. 1B, the outlet module 200 and locking plug 800 have an engaged position where the locking plug 800 is inserted into one of dual receptacles of the outlet module 200 and set to a locked state (FIGS. 8C–D). Advantageously, in the locked state the locking plug 800 cannot be inadvertently removed or partially dislodged from the outlet module 200. As shown in FIG. 1C, two locking plugs 800 can be inserted into the outlet module 200, one locking plug 800 being inserted into each receptacle 220 and each locking plug 800 inverted relative to the other.

Figure 1D:
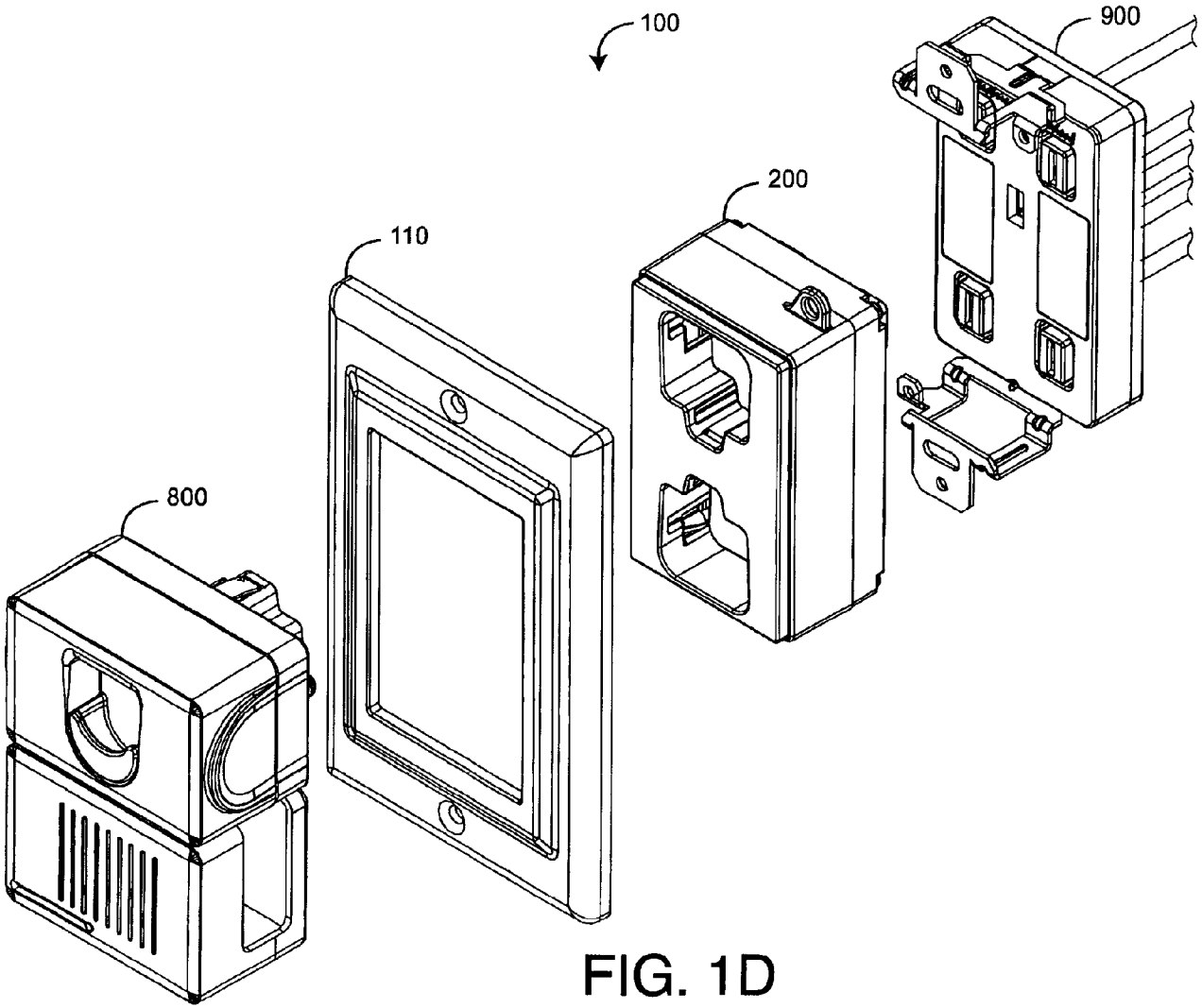

As shown in FIG. 1D, the wiring module 900 is installed within an electrical box 1000 (FIG. 10) and is wired to an electrical power source. The outlet module 200 is removably installed in the wiring module 900 and is adapted to removably receive a corresponding locking plug 800. The face plate 110 fits over, and is disposed around the perimeter of, the outlet module 200 so as to cover the electrical box 1000 (FIG. 10) and the wiring module 900 installed within and to provide a decorative trim. One or two locking plugs 800 removably connect to the outlet module 200 so as to conduct power to one or more electrical loads. A locking plug and corresponding safety outlet are described in U.S. Pat. No. 6,494,728 entitled Safety Electrical Connection System, assigned to the assignee of the present invention and incorporated by reference herein. A wiring module and replaceable functional modules are described in U.S. patent application Ser. No. 10/443,444 entitled Safety Module Electrical Distribution System, assigned to the assignee of the present invention and incorporated by reference herein.

Safety Outlet Module

Figure 2A:
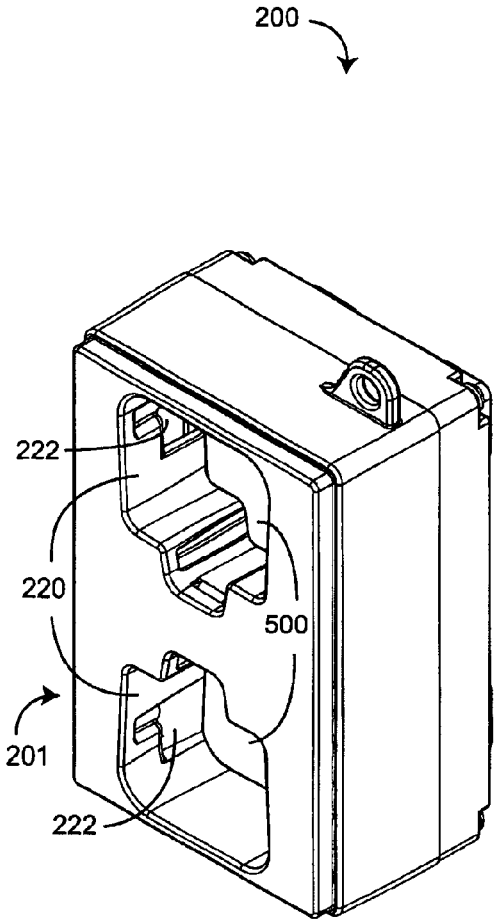
FIGS. 2A–C are front, back and exploded perspective views, respectively, of a safety outlet module.
Figure 2B:
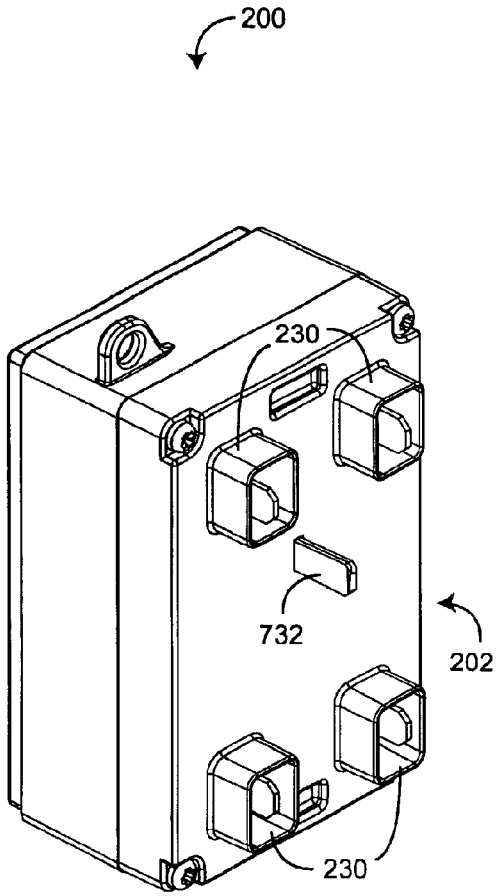
Figure 2C:
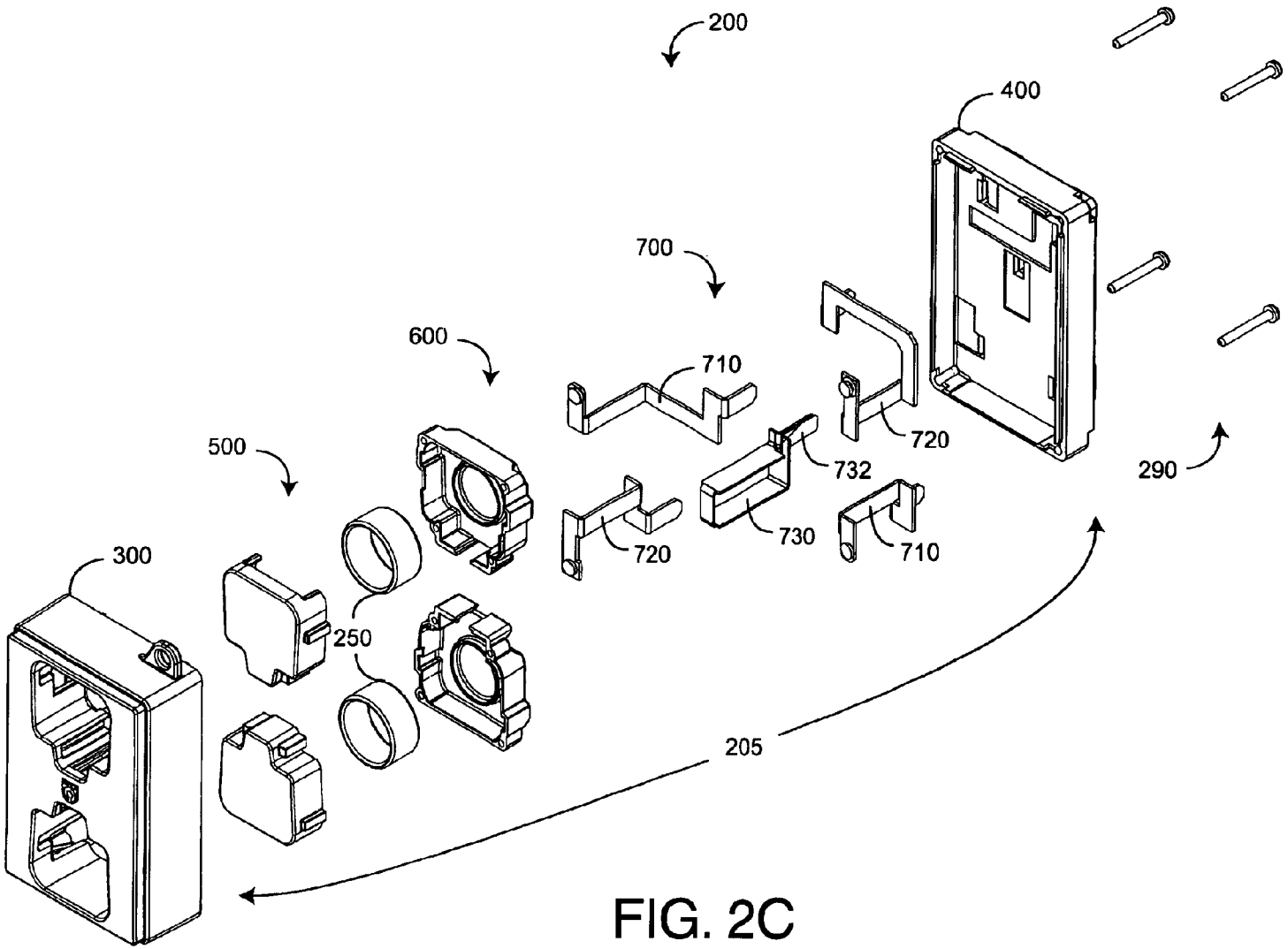
Figure 7A:
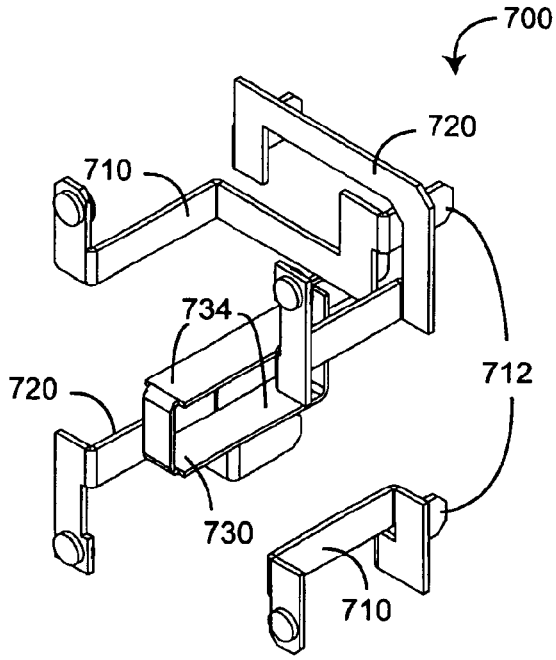
FIGS. 7A–B are front and back perspective views, respectively, of ground, hot and neutral busses.

FIGS. 2A–C illustrate a safety outlet module 200 having a functional side 201 and a plug-in side 202. As shown in FIG. 2A, the functional side 201 has dual receptacles 220 each retaining a receptacle cover 500, described in further detail with respect to FIGS. 5A–B, below. The covers 500 are shown recessed into the receptacles 220 to reveal apertures 222 within. The receptacle apertures 222 allow access to recessed receptacle contacts 714, 724 (FIG. 7A). The covers 500, apertures 222 and recessed contacts 714, 724 advantageously prevent user contact with electrical power and seal the receptacles 220 from the surrounding environment. Further, in a closed position, the covers 500 are generally flush with the face of the functional side 201, presenting a relatively featureless surface that is unlikely to attract the attention of small children and providing an aesthetic, smooth finish to an interior wall. A cover 500 is moved to an open position by insertion of a locking plug 800 (FIGS. 8A–F), which presses a cover 500 to the bottom of a corresponding receptacle 220.

Figure 9A:
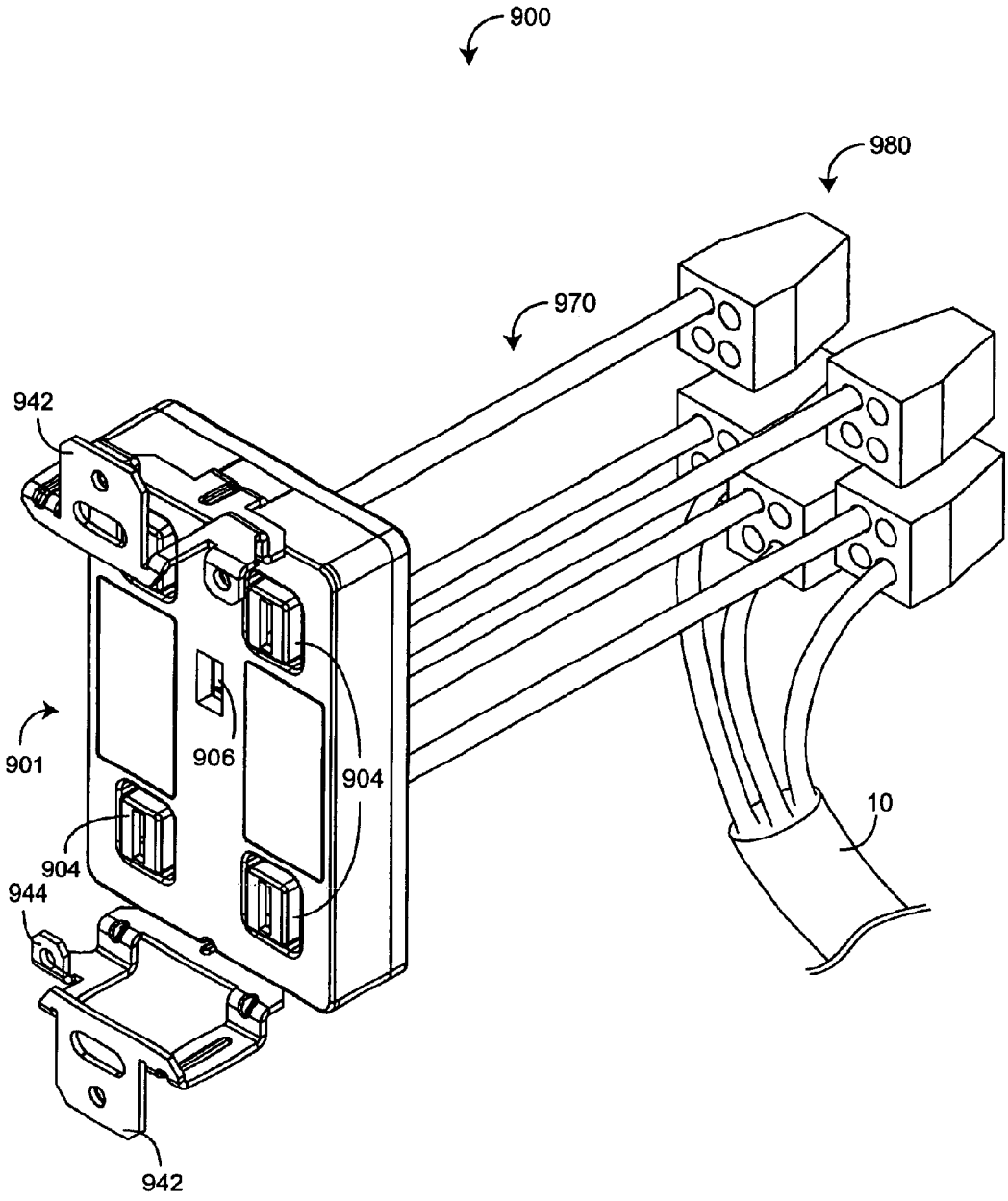
FIGS. 9A–C are front, back and exploded perspective views, respectively, of a wiring module.
Figure 9B:
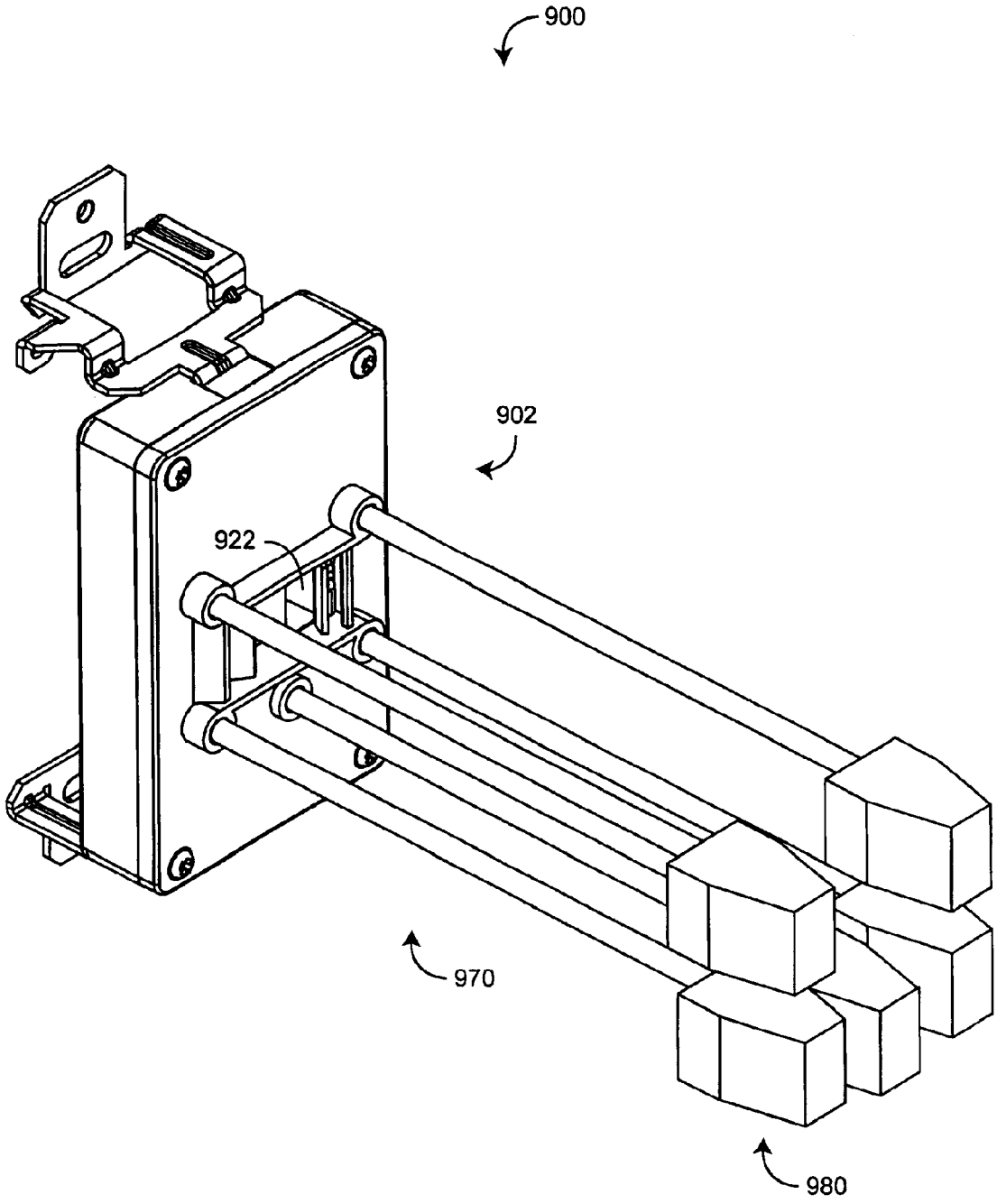
Figure 9C:
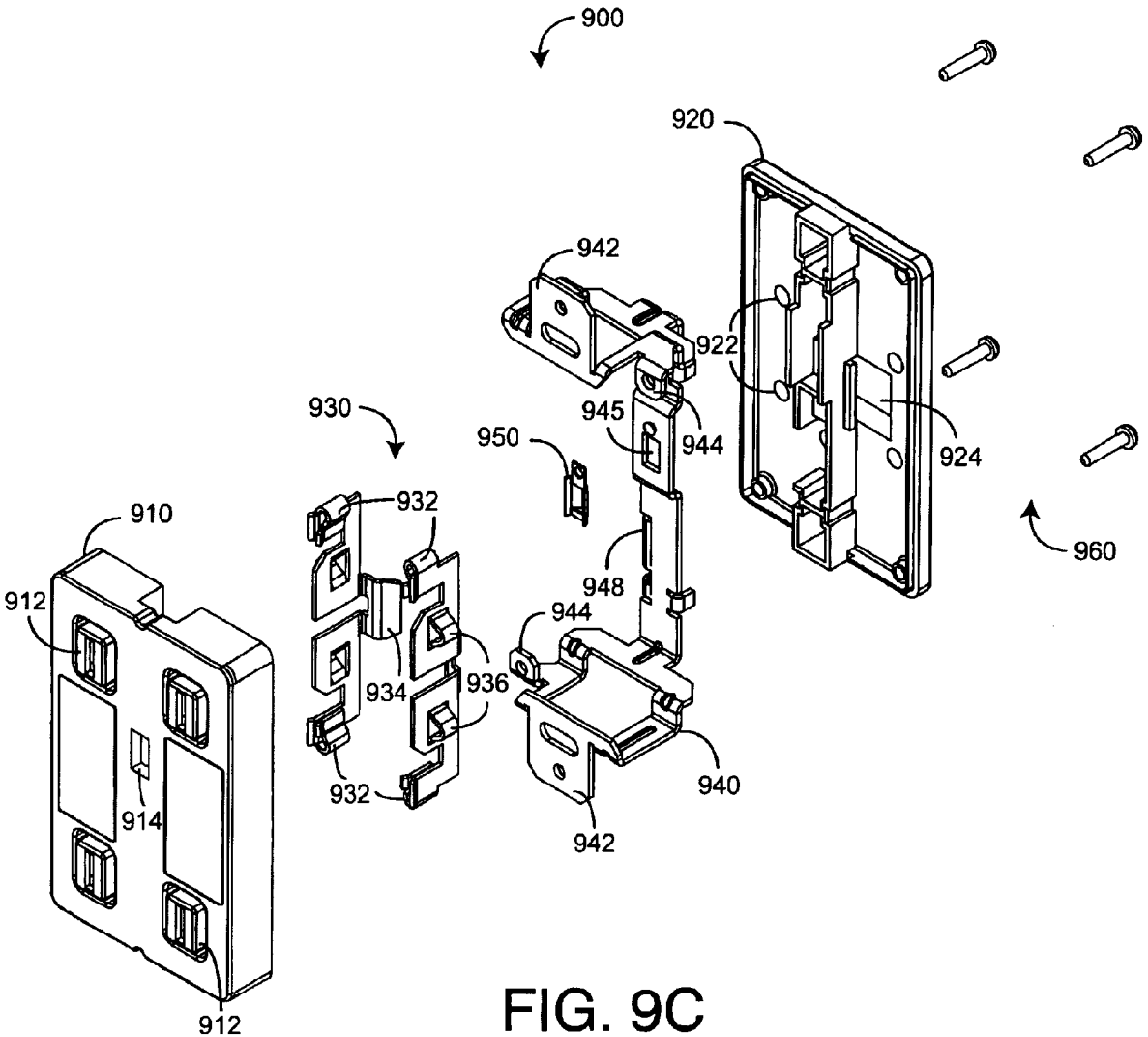

As shown in FIG. 2B, the plug-in side 202 has shielded plugs 230 and a ground bar 732 that physically and electrically connect the outlet module 200 to a wiring module 900 (FIGS. 9A–C). The shielded plugs 230 transfer electrical power to the receptacles 220, and the ground bar 732 provides a ground path for the receptacles 220. The ground bar 732 also functions as a key to assist in orienting the outlet module 200 relative to the wiring module 900 (FIGS. 9A–C). The shielded plugs 230 are configured to mate with corresponding structured sockets 904 (FIG. 9A) on the wiring module 900 (FIGS. 9A–C). In particular, when the outlet module 200 is plugged into the wiring module 900 (FIGS. 9A–C), the shielded plugs 230 mesh with the structured sockets 904 (FIG. 9A). This advantageously provides a fully enclosed shield as an electrical connection is made between the outlet module 200 and the wiring module 900 (FIGS. 9A–C), tactile feedback and a solid mechanical and electrical connection. In a particular embodiment, the shielded plugs 230 and the corresponding structured sockets 904 (FIG. 9A) are generally rectangular in shape with rounded corners.

As shown in FIG. 2C, the outlet module 200 has a front cover 300, a back cover 400, receptacle covers 500, receptacle end caps 600, cover springs 250, busses 700 and fasteners 290. The front cover 300 and back cover 400 are held together with the fasteners 290 to form a housing 205 that encloses the other outlet module components, as described with respect to FIGS. 3–4, below. The covers 500 are inserted into the receptacles 220 (FIG. 2A) from the inside face 302 (FIG. 3B) of the front cover 300 and retained within the receptacles 220 (FIG. 2A) by blocks 510 (FIG. 5A) disposed on the covers 500. The cover springs 250 are disposed between the covers 500 and the end caps 600 so as to urge the covers 500 to a closed position (FIG. 1A). The covers 500 and springs 250 are held in place by the receptacle end caps 600, which are heat staked to the front cover 300 after assembly, as described with respect to FIGS. 5–6, below. The busses 700 are held in place by the front cover 300 and partially extend through the back cover 400, as described with respect to FIG. 7, below.

Figure 3A:
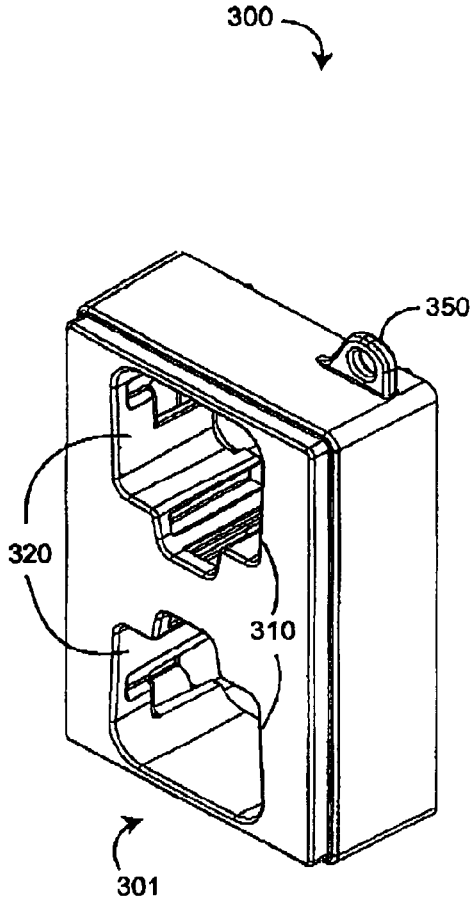
FIGS. 3A–B are front and back perspective views, respectively, of an outlet module front cover.
Figure 3B:
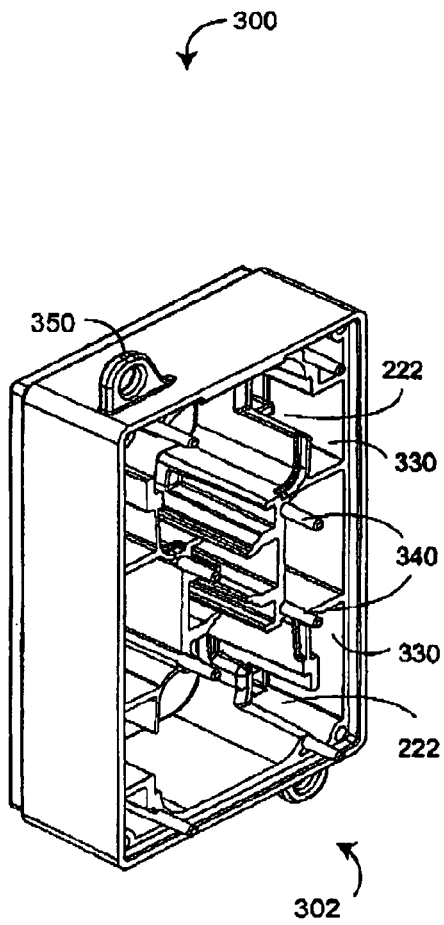

FIGS. 3A–B illustrate the front cover 300 having an outside face 301, an inside face 302, receptacle openings 310, receptacle walls 320, buss retaining structure 330, end cap posts 340 and attachment ears 350. As shown in FIG. 3A, the outside face 301 defines receptacle openings 310 that form the entry to the outlet module receptacles 220 (FIG. 2A). Receptacle walls 320 extend from the receptacle openings 310 to the interior of the front cover 300. As shown in FIG. 3B, the inside face 302 has buss retaining structure 330 that retains the busses 700 (FIGS. 7A–B). In particular, the hot and neutral busses 710, 720 (FIGS. 7A–B) are located so that the hot and neutral contacts 714, 724 (FIGS. 7A–B) are outside the receptacle walls 320 and proximate the receptacle apertures 222. The ground buss 730 (FIGS. 7A–B) is located so that the ground sleeve 734 extends along the receptacle walls 320. The end cap posts 340 accept the end caps 600 (FIGS. 6A–B), which are heat staked in place to form the receptacle bottom. The attachment ears 350 advantageously provide an integral attachment mechanism for attaching the outlet module 200 (FIGS. 2A–B) to the wiring module 900 (FIGS. 9A–C). The attachment ears 350 are located at an upper right corner and a diagonally opposite lower left corner (partially visible), and each has a fastening aperture that accepts, for example, an attachment screw.

As shown in FIG. 3A, the receptacle openings 310 and, accordingly, the cross-sections of the receptacles 220 (FIG. 2A) are advantageously shaped so as to act as a readily visible cue and a physical key to properly orient the corresponding locking plugs 800 (FIGS. 8A–F) for insertion into the receptacles 220 FIG. 2A). In one embodiment, the openings 310 and the cross-sections of the receptacles 220 (FIG. 2A) are generally trapezoidal having a wide base, a narrow base parallel to the wide base, and two lateral sides each connecting the wide base and the narrow base, with a notch extending from the narrow side. The ground sleeve 734 (FIG. 7A) is disposed within the notch. The apertures 222 (FIG. 2A) are disposed on and relatively offset along the lateral sides to correspond to the offset positions of the prongs 832 (FIGS. 8B, D) on the face of the probe 830 (FIGS. 8B, D).

Figure 4A:
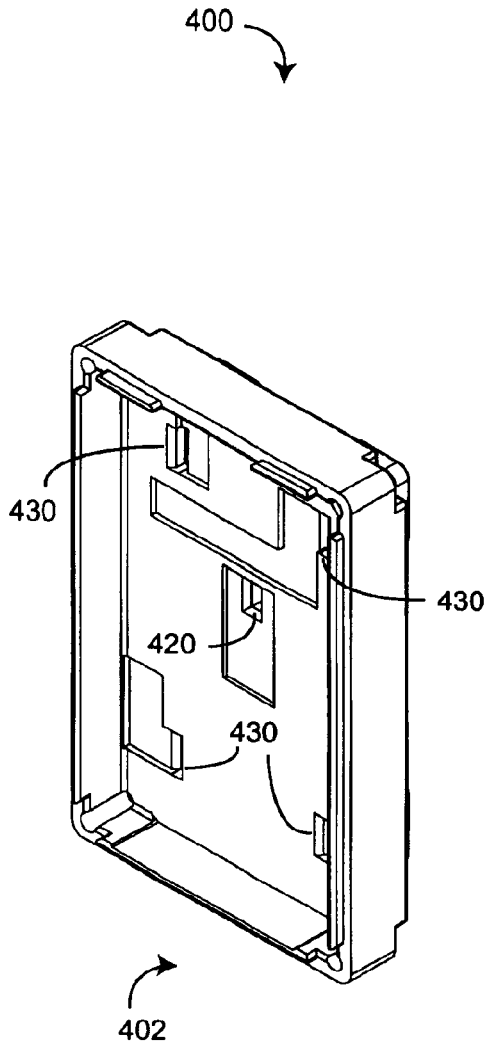
FIGS. 4A–B are front and back perspective views, respectively, of an outlet module back cover.
Figure 4B:
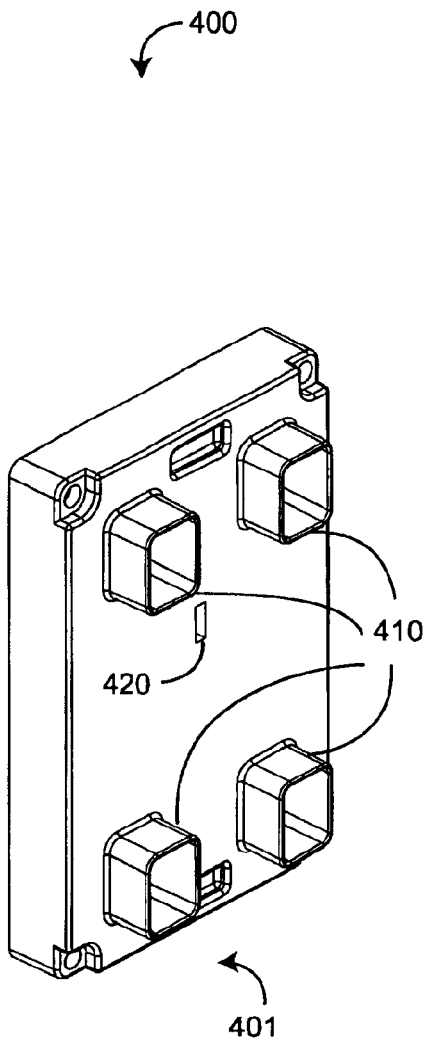

FIGS. 4A–B illustrate the rear cover 400 having an outside face 401, an inside face 402, plug shields 410, a ground bar aperture 420 and plug apertures 430. On the outside face 401, the plug shields 410 advantageously provide the shield portion of the shielded plugs 230 (FIG. 2B). Specifically, the plug shields 410 completely surround all sides of the buss plugs 712, 722 (FIGS. 7A–B). In this manner, the buss plugs 712, 722 (FIGS. 7A–B) are not exposed when the shielded plugs 230 (FIG. 2B) engage with the structured sockets 904 (FIG. 9A), even when the outlet module 200 (FIGS. 2A–B) is partially separated from the wiring module 900 (FIGS. 9A–B). The ground bar aperture 420 allows the ground bar 732 (FIGS. 7A–B) to protrude through the rear cover 400, providing a ground contact with the wiring module 900 (FIGS. 9A–B).

Figure 5A:
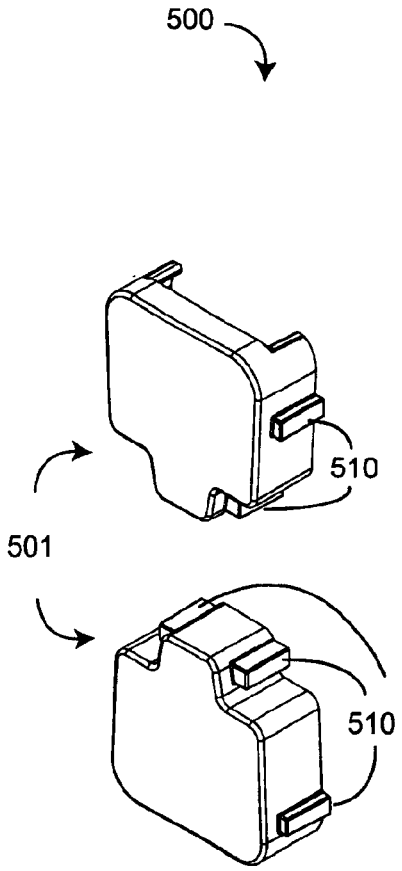
FIGS. 5A–B are front and back perspective views, respectively, of upper and lower receptacle covers.
Figure 5B:
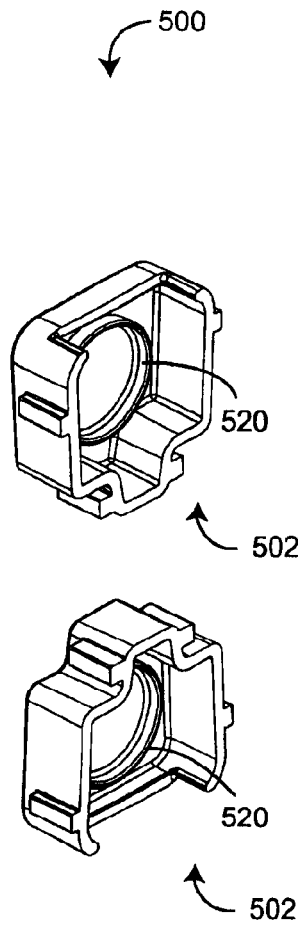

FIGS. 5A–B illustrate the top and bottom receptacle covers 500, each having an outside face 501 and an inside face 502. The covers 500 are slidably retained within the outlet module receptacles 220 (FIG. 2A) by blocks 510. The inside faces 502 have a spring structure 520 that retains the cover springs 250 (FIG. 2C).

Figure 6A:
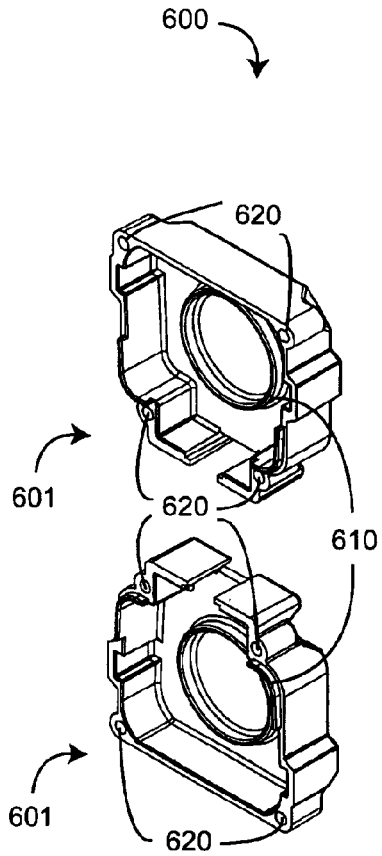
FIGS. 6A–B are back and front perspective views, respectively, of upper and lower receptacle end caps.
Figure 6B:
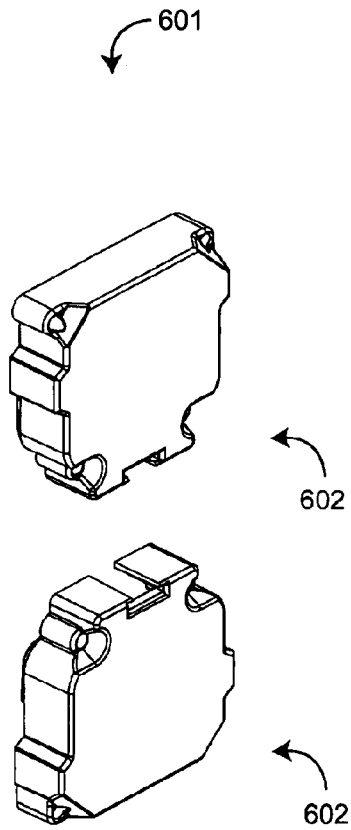
Figure 7B:
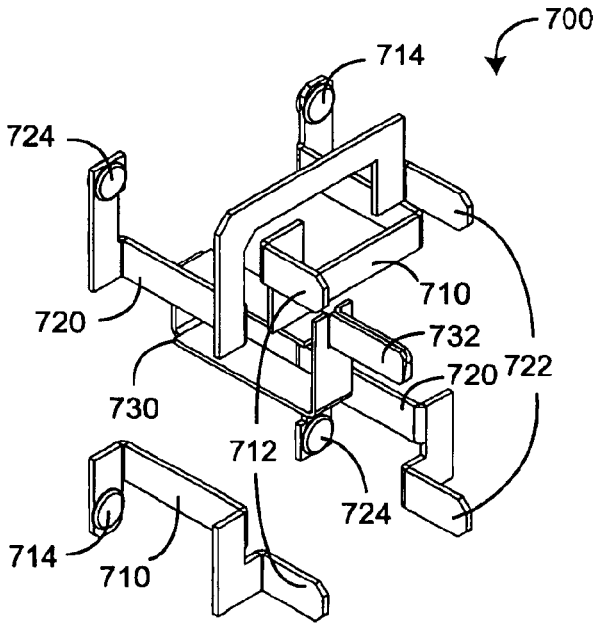

FIGS. 6A–B illustrate the receptacle end caps 600, which form the receptacle bottoms and allow the covers 500 (FIGS. 5A–B) to be inserted into the receptacles 220 (FIG. 2A) during assembly. Each end cap 600 has a first face 601 and a second face 602. The first faces 601 have a spring structure 610 that retains the cover springs 250 (FIG. 2C). Mounting apertures 620 accept corresponding mounting posts 340 (FIG. 3B) on the front cover 300 (FIGS. 3A–B). The end caps 600 are then heat staked to the mounting posts 340 (FIG. 3B) during assembly.

FIGS. 7A–B illustrate the busses 700 having hot and neutral busses 710, 720 and a ground buss 730. These busses 710–730 provide an electrical path between an external power source that is connected to the wiring module 900 (FIGS. 9A–C) and an inserted locking plug 800 (FIGS. 8A–F). In particular, the hot and neutral busses 710, 720 provide hot and neutral plugs 712, 722 that are the conductive portion of the shielded plugs 230 (FIG. 2B). Further, the hot and neutral busses 710, 720 provide hot and neutral contacts 714, 724 that are the conductive portion of the receptacles 220 (FIG. 2A). The ground buss 730 provides the ground bar 732 that is the ground path to the wiring module 900 (FIGS. 9A–B) and also the ground sleeves 734 that provide ground contacts for the receptacles 220 (FIG. 2A).

Locking Plug

FIGS. 8A–F illustrate a locking plug 800 adapted to insert into an outlet module 200 (FIGS. 2A–B) so as to connect an electrical power source to an electrical load. The locking plug 800 has a housing 810, a finger hold 820, a probe 830 and a door 840. The probe 830 is shaped in correspondence to the outlet module receptacles 220 (FIG. 2A) and is configured to retain the prongs 832.

As shown in FIGS. 8A–B, the locking plug 800 has a unlocked state with the finger hold 820 pulled out from the housing 810 and prongs 832 retracted into the probe 830. In the unlocked state, the locking plug 800 can be inserted into or removed from an outlet module receptacle 220 (FIG. 2A). As shown in FIGS. 8C–D, the locking plug 800 also has a locked state with the finger hold 820 pushed into the housing 810 and the prongs 832 extending generally perpendicularly to the sides of the probe 830. In the locked state, the prongs 832 extend through the receptacle apertures 222 (FIG. 2A) and engage corresponding outlet contacts 714, 724 (FIGS. 7A–B) and also prevent the locking plug 800 from being removed from an outlet module receptacle 220 (FIG. 2A). A ground bar 834 (FIG. 8F) is located on the probe 830 and contacts a ground sleeve 734 (FIGS. 7A–B) when the locking plug 800 is inserted into an outlet module receptacle 220 (FIG. 2A).

Figure 8E:
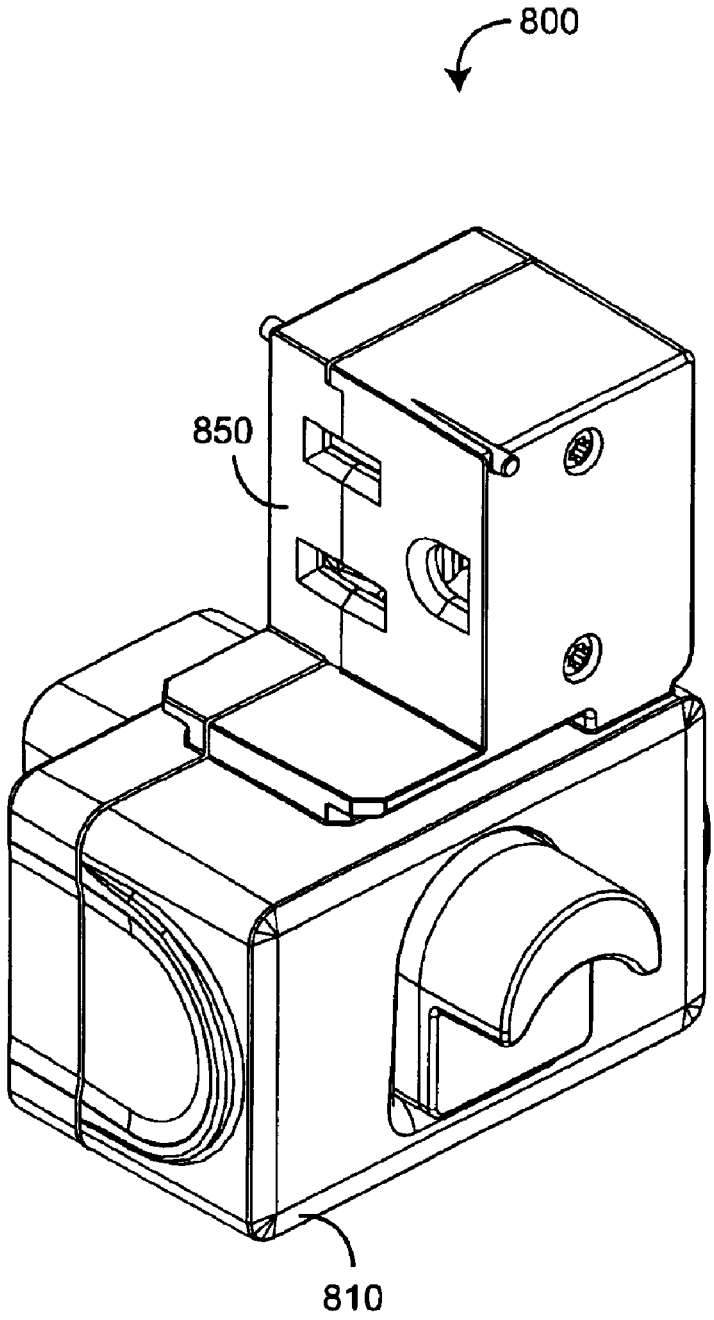

As shown in FIG. 8E, the door 840 (FIG. 8F) slides off the housing 810 to reveal a conventional electrical socket 850. The socket 850 advantageously adapts a conventional AC electrical plug to a locking plug 800. The door 840 (FIG. 8F) slides onto the housing 810 to enclose, retain and provide strain relief for a conventional plug inserted into an adapter socket 850. The door 840 (FIG. 8F) is held in place with a retaining screw 842 (FIG. 8F) threaded through one of several adjustment holes, allowing the door 840 (FIG. 8F) to accommodate various sized standard AC plugs. In an alternative embodiment, a locking plug can be directly attached to an electrical wire, eliminating the adapter socket 850.

Figure 8F:
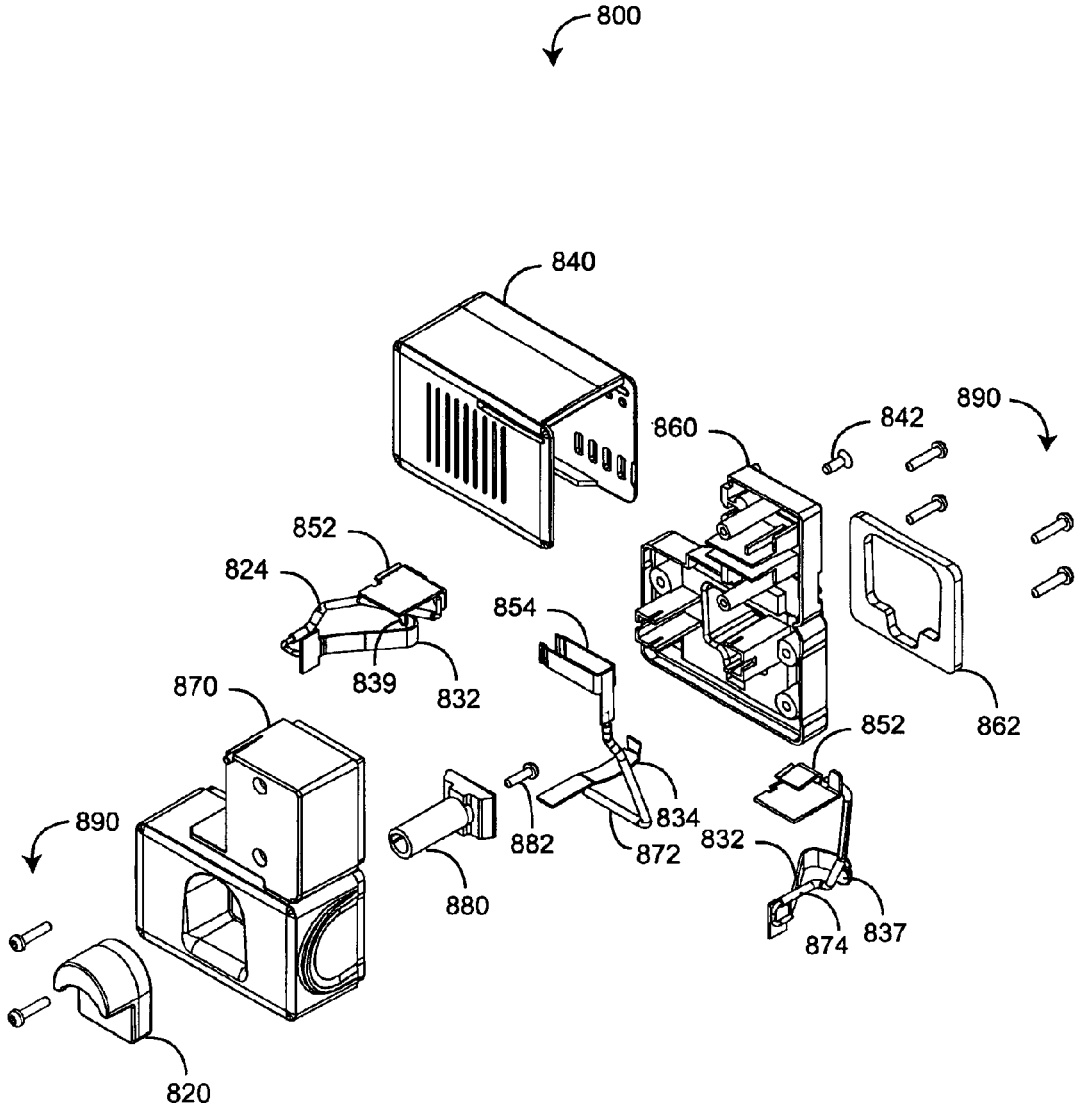

As shown in FIG. 8F, a locking plug 800 has a front cover 860 and back cover 870 that comprise the housing 810 (FIGS. 8A–E), a finger hold 820, a probe 830 (FIGS. 8A–D) extending from the front cover 860, a gasket 862, a door 840, prongs 832, socket clips 852, a ground bar 834, a ground clip 854, a slide 880, and fasteners 890. The front cover 860 and back cover 870 are held together with fasteners 890, enclose the plug contacts 852, 854, prongs 832 and ground bar 834 provide a corresponding adapter socket 850 (FIG. 8E) for a standard AC plug, and provide a probe 830 for insertion into the corresponding receptacle 220 (FIG. 2A). A gasket 862 fitted around the probe 830 provides a seal between the outlet module 200 (FIGS. 2A–B) and the locking plug 800 when inserted.

Also shown in FIG. 8F, the finger hold 820 is attached to a slide 880 that is inserted through the back cover 870 and secured with a fastener 882. The slide 880 is moveable within the probe 830 so as to actuate the prongs 832. Specifically, when the finger hold 820 is pulled out from the housing 810, the slide 880 allows the prongs 832 to retract. When the finger hold 820 is pushed into the housing 810, the slide 880 forces the prongs 832 outward, causing them to extend from the probe 830.

Further shown in FIG. 8F, a ground jumper 872 electrically connects the ground bar 834 to the ground clip 854. A standard AC plug ground pin connects with the ground clip 854 when inserted into the adapter socket 850 (FIG. 8E). The prongs 832 have hot and neutral contacts 837, 839. When the locking plug 800 is inserted in the outlet module 200 (FIGS. 2A–B) and placed in the locked position, the prongs 832 extend so that the hot and neutral contacts 837, 839 separately connect with hot and neutral outlet contacts 714, 724 (FIGS. 7A–B). Jumpers 874 electrically connect the prongs 832 to the hot and neutral clips 852, respectively. Standard AC plug hot and neutral blades connect with the hot and neutral clips 852, respectively, when inserted into the adapter socket 850 (FIG. 8E).

In an alternative embodiment, the locking plug has side actuated buttons for actuating the prongs. The buttons retain a spring so as to urge the buttons outward, placing the prongs in an extended position. The knobs are manually compressed to place the prongs in a retracted position for plug insertion into or removal from the outlet module.

Wiring Module

FIGS. 9A–C illustrate a wiring module 900 adapted for installation into a standard electrical box. Installed within an electrical box, the wiring panel advantageously partitions the box into a module compartment allowing user access and a wiring compartment shielding users from electrical power connections. The wiring module 900 is configured to removably retain electrical distribution modules, such as a safety outlet module 200 (FIGS. 2A–B), in addition to other functional modules, such as switch modules and conventional outlet modules.

As shown in FIGS. 9A–B, the wiring module 900 has a functional side 901 and a wiring side 902. The wiring module 900 is configured to mount within a conventional electrical box 1000 (FIG. 10), secured with attachment screws (not shown) threaded through box mounts 942. A functional module, such as the safety outlet module 200 (FIGS. 2A–B) plugs into the wiring module functional side 901, secured to the wiring module 900 with attachment screws (not shown) that thread through attachment ears 350 (FIGS. 3A–B) and corresponding module mounts 944. A power cable 10 routed to the electrical box 1000 (FIG. 10) attaches to push-wire connectors 980 at the end of fixed wires 970 extending from the wiring module wiring side 902. The functional side 901 has structured sockets 904, and a ground socket 906. The structured sockets 904 mesh with outlet module shielded plugs 230 (FIG. 2B), and the ground socket 906 accommodates the ground bar 732 (FIG. 2B).

As shown in FIG. 9C, the wiring module 900 has a front cover 910, a back cover 920, a terminal set 930, a mounting bracket 940, a ground bar clip 950 and fasteners 960. The front cover 910 and back cover 920 are secured together with the fasteners 960 and enclose the terminal set 930. The mounting bracket 940 is partially enclosed by, and retained between, the front cover 910 and back cover 920 so as to secure the mounting bracket 940 to, and mechanically and electrically integrate the mounting bracket 940 with, the wiring module 900. The front cover 910 has socket insulators 912 and a ground aperture 914. The insulators 912 form the structured portion of the structured sockets 904 (FIG. 9A) and contain the power clips 932. The ground aperture 914 forms a portion of the ground socket 906 (FIG. 9A). The back cover 920 has wire apertures 922 and breakaway apertures 924. The wire apertures 922 are adapted to the fixed wires 970 (FIGS. 9A–B) so as to provide a seal around and strain relief for the fixed wires 970 and to provide access to the terminal set 930 and ground terminal 948 (partially hidden). The breakaway apertures 924 allow user access to the breakaways 934 within an assembled wiring module 900.

Also shown in FIG. 9C, the terminal set 930 has power clips 932, breakaways 934, and fixed wire terminals 936. The power clips 932 provide the conductor portion of the structured sockets 904 (FIG. 9A) and are configured to physically and electrically connect with the outlet module plugs 712, 722 (FIGS. 7A–B). The breakaways 934 are removable to selectively isolate individual power clips 932. The fixed wire terminals 936 electrically and mechanically connect a striped end of the fixed wires 970 (FIGS. 9A–B) to the terminal set 930.

Figure 10:
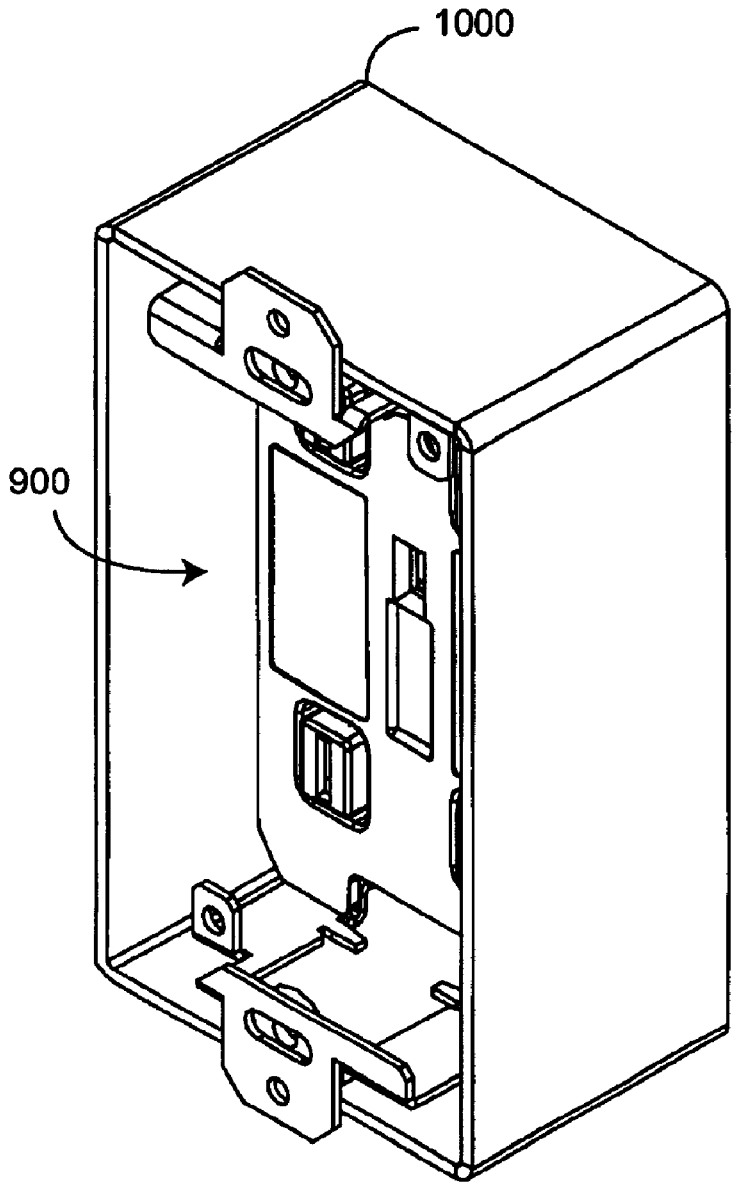
FIG. 10 is a front perspective view of an electrical box having an installed wiring module.

Further shown in FIG. 9C, the mounting bracket 940 has box mounts 942, module mounts 944, a ground clip aperture 945 and a ground terminal 948. The box mounts 942 accept fasteners (not shown) to secure the bracket to an electrical box 1000 (FIG. 10). The module mounts 944 accept fasteners (not shown) to secure the outlet module 200 (FIGS. 2A–B) to the wiring module 900. The ground clip aperture 945 is adapted to the ground clip 950, which connects the outlet module ground bar 732 (FIGS. 7A–B) electrically and mechanically to the bracket 940. The bracket 940 has an integrated rivet for securing the ground clip 950 within the aperture 945. The ground terminal 948 electrically and mechanically connects a striped end of a ground one of the fixed wires 970 (FIGS. 9A–B) to the bracket 940.

A safety outlet module have been disclosed in detail in connection with various embodiments. These embodiments are disclosed by way of examples only and are not to limit the scope of the claims that follow. One of ordinary skill in the art will appreciate many variations and modifications.

What is claimed is:

1. An outlet module comprising:

a housing;

a receptacle defined by said housing and having an opening, a bottom and a wall extending between said opening and said bottom;

an aperture defined within said receptacle and partially extending along said wall;

a cover slidably retained within said receptacle and having a closed position proximate said opening and an open position proximate said bottom, said aperture blocked in said closed position and exposed in said open position;

a plug retained at least partially within said housing and extending from a housing face, said plug adapted to removably connect to an electrical power source; and a buss internal to said housing providing a electrical path between said plug and said receptacle, said wall interior to said housing.

2. The outlet module according to claim 1 further comprising a shield extending from said housing face and disposed around said plug so as to substantially enclose said plug.

3. The outlet module according to claim 2 further comprising:

a ground bar extending from said housing face;

a ground sleeve disposed within said receptacle and extending along said wall; and a ground buss internal to said housing connecting said ground sleeve to said ground bar.

4. The outlet module according to claim 3 further comprising:

a second aperture defined within said receptacle and partially extending along said wall;

a second plug retained at least partially within said housing and extending from said housing face, said second plug adapted to removably connect to said electrical power source;

a second buss internal to said housing providing an electrical path between said second plug and said receptacle, said busses providing hot and neutral electrical paths between said plugs and said receptacle.

5. The outlet module according to claim 4 further comprising:

an end cap attachable to said housing so as to form said receptacle bottom; and a spring retained between said end cap and said cover so as to urge said cover to said closed position.

6. The outlet module according to claim 5 further wherein said receptacle has a cross-section generally comprising:

a trapezoid having a wide base, a narrow base parallel to said wide base, and two lateral sides each connecting said wide base and said narrow base; and a notch extending from said narrow side.

7. The outlet module according to claim 6 wherein said ground sleeve is disposed within said notch.

8. The outlet module according to claim 6 wherein said apertures are disposed on said lateral sides.

9. The outlet module according to claim 8 wherein said apertures are relatively offset along said lateral sides.

10. The outlet module according to claim 4 further comprising:

a plurality of attachment ears disposed on diagonal corners of said housing and adapted to mount said housing to a wiring panel disposed within an electrical box.

11. The outlet module according to claim 5 further comprising a plurality of posts extending from an inside portion of said housing, said end cap heat staked to said posts.

12. The outlet module according to claim 11 wherein said cover comprises a plurality of blocks configured to retain said cover within said receptacle.

13. An outlet module comprising:

a housing;

a plurality of shielded plugs extending from a plug-in side of said housing, said shielded plugs adapted to mesh with a corresponding plurality of structured sockets disposed on a wiring module so as to electrically communicate with a power cable wire to said wiring module; and a plurality of covered receptacles disposed on a functional side of said housing, each of said receptacles adapted to receive a corresponding plurality of lucking plugs, wherein said shielded plugs are configured to transmit electrical power to said covered receptacles, and said covered receptacles are configured to transmit electrical power to said lucking plugs.

14. The outlet module according to claim 13 further comprising:

a plurality of apertures disposed within said receptacles; and a plurality of busses recessed from said receptacles proximate said apertures, wherein said apertures are adapted to pass through to said busses a corresponding plurality of prongs extending from said locking plug so as to enable said prongs to electrically connect with said busses and to retain said locking plugs within said receptacles.

15. The outlet module according to claim 14 further comprising a plurality of attachment ears disposed on said housing and adapted to install said housing within an electrical box in conjunction with said wiring module.

16. The outlet module according to claim 15 further comprising:

a plurality of covers inserted into said receptacles from an inside portion of said housing and retained within said receptacles by blocks disposed on said covers;

a plurality of end caps attached to said inside portion of said housing so as to form bottom portions of said receptacles; and a plurality of cover springs disposed between said covers and said end caps so as to urge said covers to a closed position.

* * * * *